US006338660B1

(12) United States Patent
Fukuda

(10) Patent No.: US 6,338,660 B1
(45) Date of Patent: Jan. 15, 2002

(54) EXHAUST SYSTEM FOR AN OUTBOARD MOTOR

(75) Inventor: Katsuhiro Fukuda, Shizuoka-ken (JP)

(73) Assignee: Suzuki Motor Corporation, Hamamatsu (JP)

( * ) Notice: Subject to any disclaimer, the term of this patent is extended or adjusted under 35 U.S.C. 154(b) by 0 days.

(21) Appl. No.: 09/615,604

(22) Filed: Jul. 13, 2000

(30) Foreign Application Priority Data

Jul. 14, 1999 (JP) ..... 11-200905

(51) Int. Cl.[7] ..... B63H 21/32
(52) U.S. Cl. ..... 440/89; 60/313; 123/509
(58) Field of Search ..... 440/88, 89; 60/313; 123/509

(56) References Cited

U.S. PATENT DOCUMENTS 5,893,783 A * 4/1999 Hiraoka et al. ..... 440/89
5,943,996 A * 8/1999 Sogawa et al. ..... 123/509
6,039,012 A * 3/2000 Motoyama ..... 440/89

FOREIGN PATENT DOCUMENTS

JP 9-49425 2/1997

* cited by examiner

*Primary Examiner*—Jesus D. Sotelo
(74) *Attorney, Agent, or Firm*—Finnegan, Henderson, Farabow, Garrett & Dunner, L.L.P.

(57) ABSTRACT

An exhaust system for an outboard motor with a four-stroke engine having a cylinder block including a plurality of cylinders. The cylinders are arranged vertically so that a crankshaft is vertically oriented. The cylinders have different respective exhaust timings. The exhaust system further includes a plurality of separate exhaust passages that extend vertically and are formed integrally with the cylinder block. Each exhaust port from each cylinder communicates with at least one of the plurality of exhaust passages. Also, the exhaust port from the cylinder disposed at the lowest position among the plurality of cylinders communicates with the most distantly disposed exhaust passage out of the plurality of the exhaust passages. Further, the exhaust passages are joined at a point which is further downstream than the exhaust port from the lowest cylinder. The exhaust system provides a simple design with enhanced engine performance that enables group exhaust from a plurality of cylinders while preventing exhaust interference from occurring.

13 Claims, 11 Drawing Sheets

EXHAUST SYSTEM FOR AN OUTBOARD MOTOR

FIELD OF THE INVENTION

The present invention relates to an exhaust system for an outboard motor with enhanced engine performance by preventing exhaust interference from occurring between a plurality of cylinders.

BACKGROUND OF THE INVENTION

In a multi-cylinder four-stroke engine which is mounted in a vehicle, such as an automobile or a motorcycle, a plurality of exhaust pipes coming from each cylinder, each having a different respective exhaust timing, are joined together to make a group exhaust. By eliminating both positive pressure waves and negative pressure waves, which are generated by the pulsation of the exhaust gases, the charging efficiency of the intake fuel-air mixture and the engine performance, such as output characteristics and torque characteristics, are improved. In four cylinder engines, for example, four exhaust pipes from each cylinder are joined into two, and subsequently into one; thereby forming a 4-2-1 type group exhaust system that is often used. In addition, it is desirable that the differences in lengths between the exhaust pipes extending from each cylinder are small.

However, in an ordinary four-stroke engine for an outboard motor, the engine is mounted vertically so that the crankshaft is oriented in a vertical direction, as shown in FIG. 11. Exhaust passages 101, which extend vertically, are provided along the side of the cylinder block 100. In a four-cylinder engine, for example, four exhaust ports (not shown) from four cylinders 102A–102D communicate with the exhaust passage 101. Exhaust gases discharged from each cylinder 102A–102D are collected inside the exhaust passage 101, flow downward and are subsequently discharged into water.

In this type of outboard motor, group exhaust does not occur. All exhaust gases discharged by each cylinder 102A–102D are collected inside one exhaust passage 101. As a result, it has the disadvantage that exhaust interference occurs among those cylinders which have the same exhaust timing, which results in decreased output or worsened torque characteristics.

In order to prevent such exhaust interference from occurring, and to apply the 4-2-1 group exhaust system discussed above, one easy method involves providing a separate exhaust manifold to the cylinder block, as disclosed in Japanese Laid-Open Patent Publication No. Hei-9-49425.

However, if, as described above, a separate exhaust manifold is mounted to the cylinder block, the number of components will increase, which will cause productivity and assembling efficiency to worsen. Additionally, in the case of an outboard motor, the engine is covered by an engine cover, and air inside the engine cover is used as intake air for the engine. However, the temperature within the engine cover is increased by the heat emitted from the exhaust manifold. Due to this, the density of the intake air is decreased, which results in the possibility of decreased performance or decreased durability of components. To prevent this, it is necessary to form a water jacket around the exhaust manifold, and thereby the structure of the manifold becomes complex and leads to larger manufacturing costs. Further, the possibility of problems, such as water leaks, increase accordingly.

The four-stroke engine for an outboard motor of the present invention was invented to solve the problems described above. Having a simple structure, good productivity and design characteristics, the exhaust system of the present invention makes group exhaust possible, prevents exhaust interference from occurring, and increases the cooling efficiency of the exhaust passages.

SUMMARY OF THE INVENTION

In order to solve the problems described above, the present invention provides an exhaust system for an outboard motor, which, as described in claim 1, is equipped with a four-stroke engine having a cylinder block comprising a plurality of cylinders which are arranged vertically so that the crankshaft is vertically oriented. The exhaust system includes a plurality of separate exhaust passages that extend vertically and are formed integrally with the cylinder block. Each of the exhaust ports from each cylinder which have different respective exhaust timings communicates with one of the plurality of exhaust passages.

By constructing the exhaust system for an outboard motor as described above, as a plurality of independent exhaust passages are integrally formed along with the cylinder block, it becomes possible to discharge exhaust gases in groups, while making the exhaust passages of a simple structure without increasing the number of components for the engine. This results in enhanced engine performance. Further, as the exhaust passages are easily formed along with the cylinder block by die-casting, the manufacturing efficiencies of the engine (cylinder block) and the exhaust system are extremely good.

Also, in the present invention relating to an exhaust system for an outboard motor the exhaust port from the cylinder disposed in the lowest position out of the plurality of the cylinders communicates with the most distantly disposed exhaust passage out of the plurality of exhaust passages. With this arrangement, it becomes possible to form the exhaust port from the cylinder disposed at the lowest position longer than the exhaust port from the cylinder disposed at higher positions. Thus, the differences in lengths of the exhaust passages, including the exhaust port, are decreased. As a result, exhaust interference is more effectively prevented from occurring.

Further, in the present invention relating to an exhaust system for an outboard motor the plurality of exhaust passages are joined together at a point which is farther downstream than the point where the exhaust port from the lowest cylinder communicates with one of the exhaust passages. With this arrangement, all of the cylinder exhaust ports communicate with one of the exhaust passages, and then the exhaust passages are joined together. Therefore, effective group exhaust becomes possible. Further, the exhaust passage that is formed from components below the cylinder block is made into one simple structure.

Still further, in the present invention relating to an exhaust system for an outboard motor the plurality of exhaust passages are arranged to be disposed in a line in the width direction of the outboard motor. With this arrangement, by only changing the length of each exhaust port, it becomes possible to select a combination of groups of exhaust passages, as well as to make a simply designed exhaust system.

Moreover, in the present invention relating to an exhaust system for an outboard motor the plurality of exhaust passages are arranged to be disposed in a line in the front to rear direction of the outboard motor. By this arrangement, because a plurality of exhaust passages do not protrude over the side face of the cylinder block, it becomes possible to provide a plurality of exhaust passages to make effective use of space, as well as to make a simple exhaust system design.

Furthermore, in the present invention relating to an exhaust system for an outboard motor a water jacket is formed within the bulkhead that partitions the plurality of exhaust passages. By including this water jacket, it becomes possible to increase the cooling efficiency within the exhaust passages.

Still further, in the present invention relating to an exhaust system for an outboard motor the water jacket formed within the bulkhead communicates with a water jacket that is provided around the exhaust passages. By this arrangement, the ability of cooling water to circulate within the water jacket in the bulkhead improves. The cooling efficiency of the exhaust passages is also greatly improved.

The present invention also provides an exhaust system for an outboard motor is equipped with a four-stroke engine having a cylinder block that includes a plurality of cylinders and a plurality of separate exhaust passages. The cylinders are arranged vertically so that a crankshaft is vertically oriented and the cylinders have different respective exhaust timings. Each cylinder has an exhaust port. Each exhaust passage extends in the vertical direction and is formed integrally with the cylinder block. Each exhaust port from each cylinder communicates with at least one of the plurality of exhaust passages.

In one embodiment of the present invention relating to an exhaust system for an outboard motor the plurality of exhaust passages are comprised of an inner exhaust passage and an outer exhaust passage which are arranged in a line in the width direction of the outboard motor. The exhaust port from the cylinder disposed in the lowest position out of the plurality of cylinders communicates with the outer exhaust passage.

In a second embodiment of the present invention relating to an exhaust system for an outboard motor the plurality of exhaust passages are comprised of a front exhaust passage and a rear exhaust passage which are arranged in a line in the front to rear direction of the outboard motor. The structure further includes a joint passage, such that the exhaust port from the cylinder disposed in the lowest position out of the plurality of cylinders communicates with the front exhaust passage through the joint passage.

Also, in the present invention relating to an exhaust system for an outboard motor the plurality of exhaust passages are joined to each other at a point below the exhaust port connection point of the lowest cylinder.

Further, in the present invention relating to an exhaust system for an outboard motor a water jacket is formed within a bulkhead that partitions the plurality of exhaust passages. The water jacket formed within the bulkhead communicates with a water jacket that is provided around the plurality of exhaust passages.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

DESCRIPTION OF THE PREFERRED EMBODIMENTS

Reference will now be made in detail to the present preferred embodiments of the invention, examples of which are illustrated in the accompanying drawings.

Figure 1:
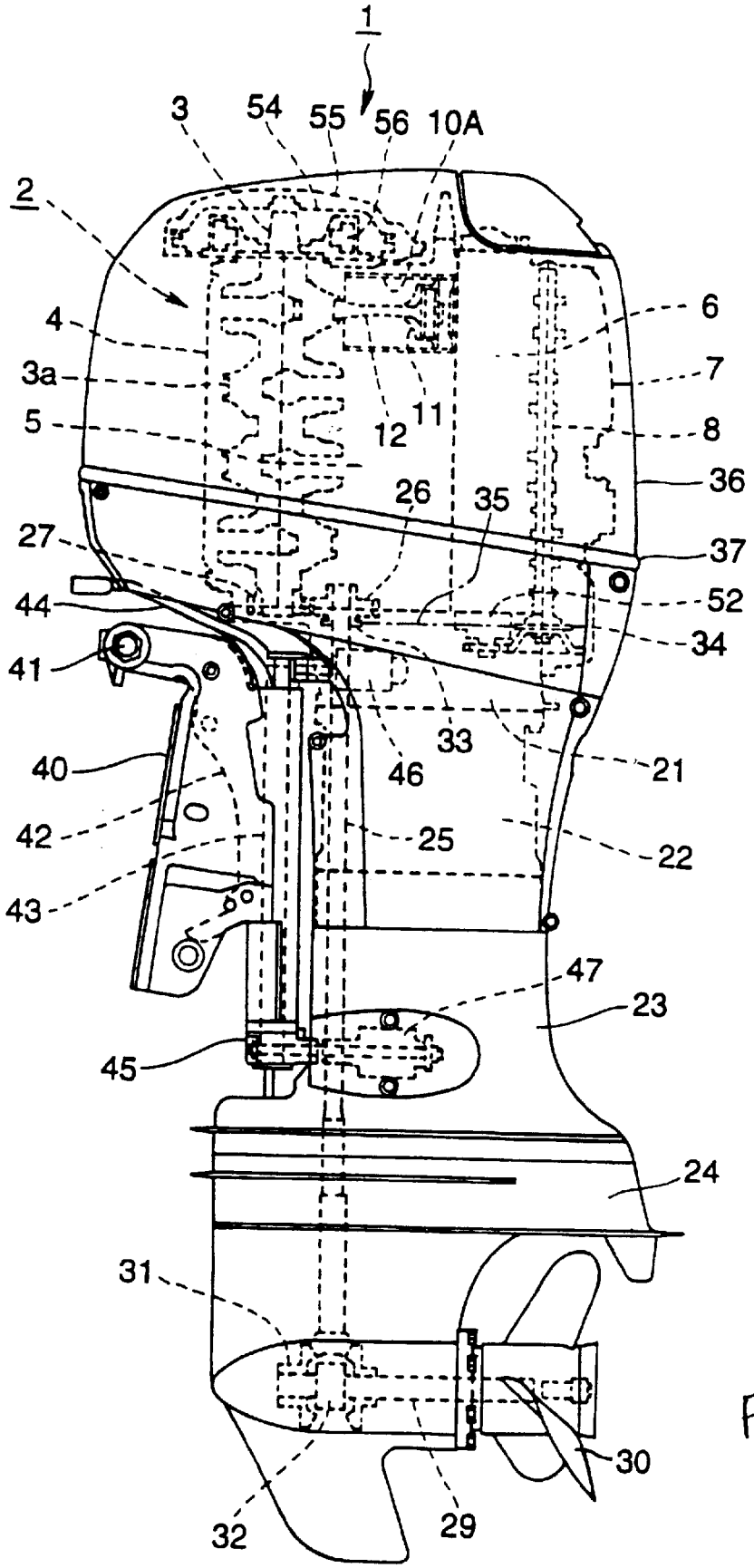
FIG. 1 is a left side view of an outboard motor provided with an exhaust system of the prevent invention.

FIG. 1 is a left side view of an outboard motor incorporated with an exhaust system of the present invention. As shown in FIG. 1, the left side represents the front side (the hull side) of the outboard motor, while the right side represents the rear of the motor. FIGS. 2 through 7 show examples of one embodiment of an exhaust system of the present invention.

Figure 2:
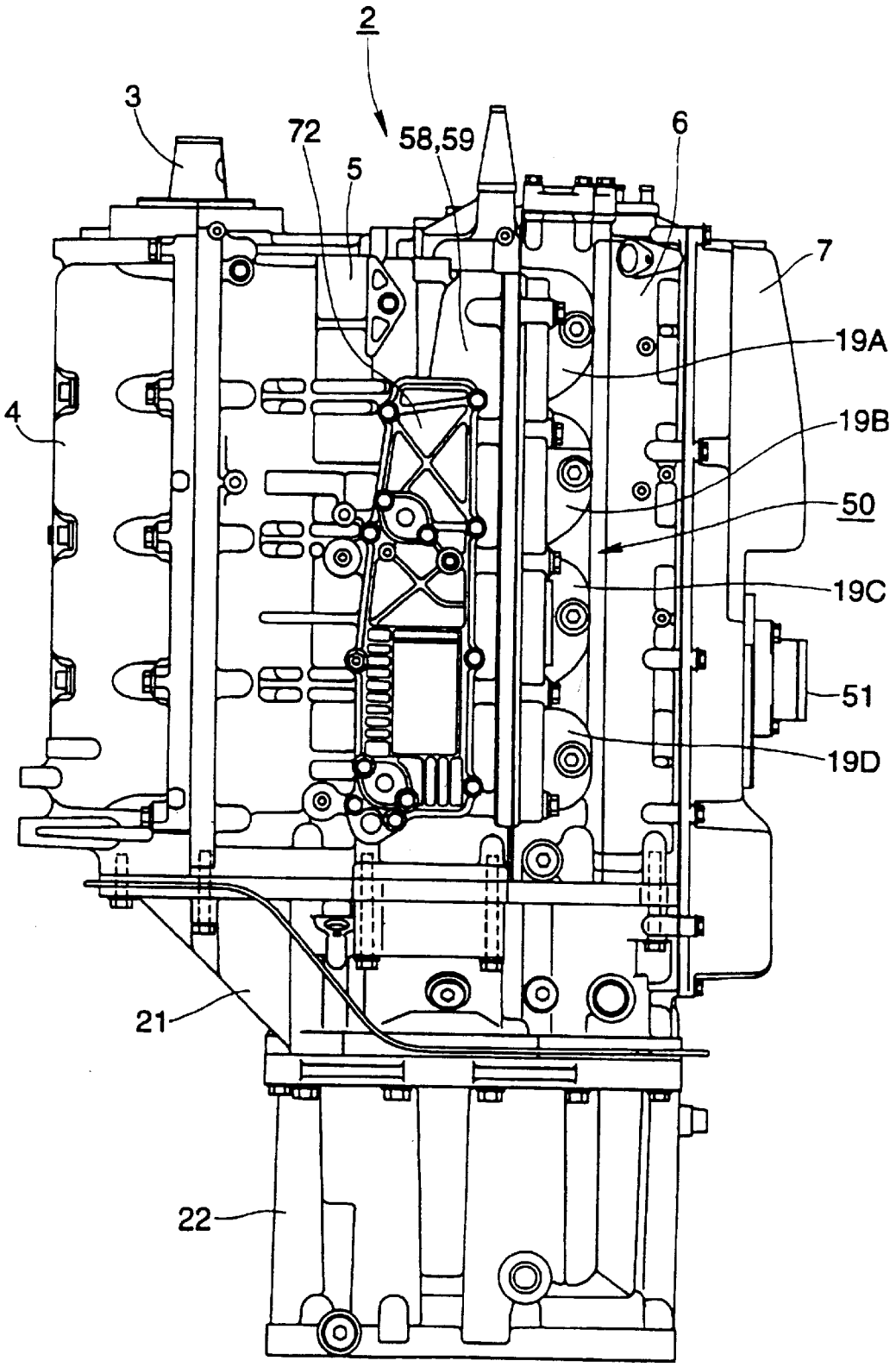
FIG. 2 is a left side view of the engine, the engine holder and the oil pan.

In the uppermost portion of the outboard motor 1, an in-line four-cylinder, four-stroke engine 2 is mounted. The engine 2 is mounted vertically so that a provided crankshaft 3 is oriented in the vertical direction. As shown in FIGS. 1 and 2, the engine 2 comprises, in sequence from the front side, a crankcase 4, a cylinder block 5, a cylinder head 6 and a head cover 7. The crankshaft 3 is supported by being sandwiched between the crankcase 4 and the cylinder block 5, while a pair of right and left camshafts 8 within the cylinder head 6 are supported vertically.

Figure 4:
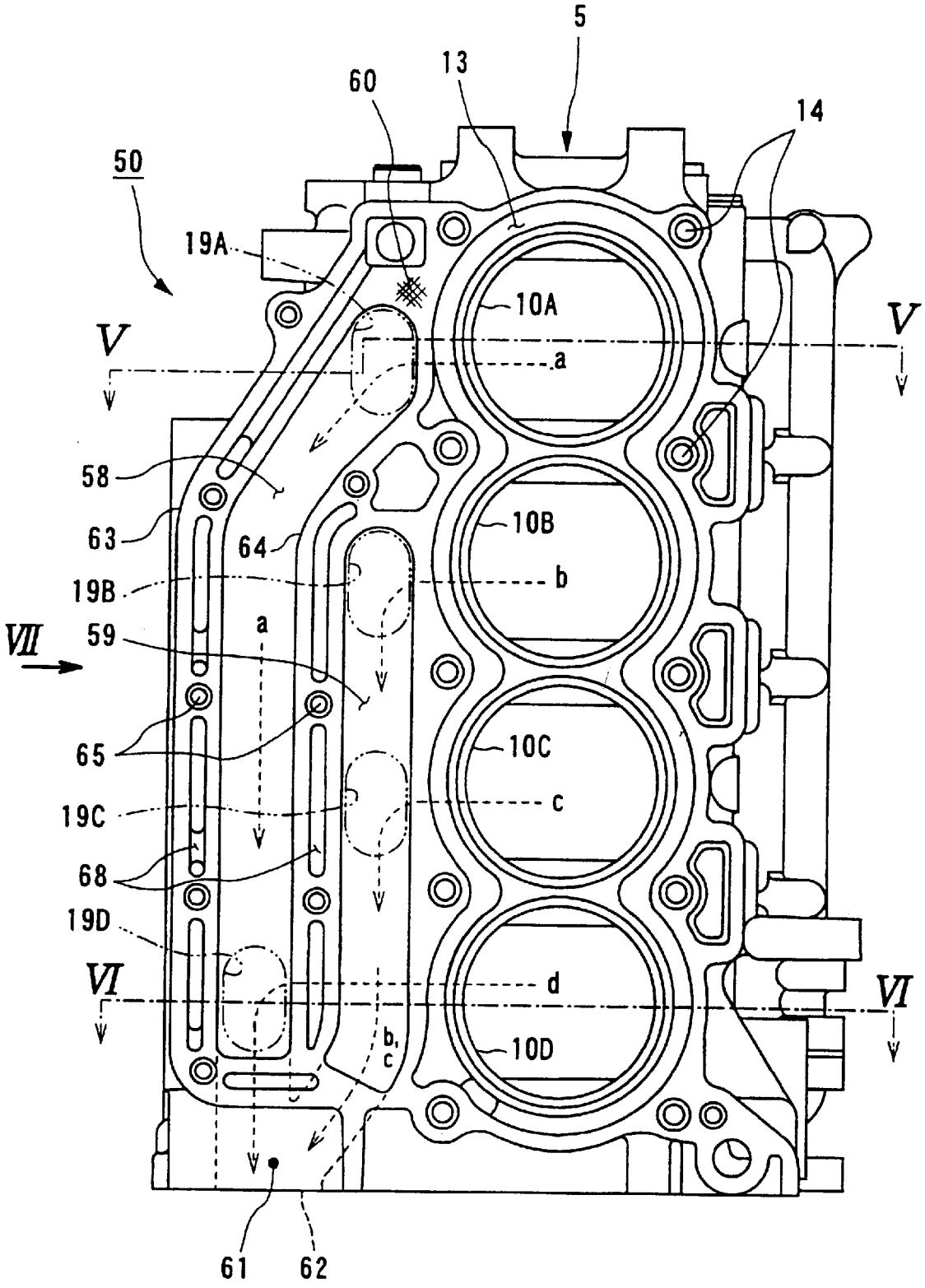
FIG. 4 is a rear view of a cylinder block showing one embodiment of the present invention.

As shown in FIGS. 1, 4, 5 and 6, in one embodiment, four cylinders (cylinder bores) 10A–10D extend horizontally in the front-rear direction. The four cylinders 10A–10D are formed vertically in a single line within the cylinder block 5. Referring to FIG. 1, a piston 11 is inserted so as to slide freely within each cylinder 10A–10D and is connected to a crank pin 3*a* of the crankshaft 3 by a con rod 12. Reciprocating movement of the piston 11 within the cylinders 10A–10D rotates the crankshaft 3. As shown in FIG. 4, around the cylinders 10A–10D, a plurality of water jackets 13 for circulating cooling water are formed. Around the outside of the cylinders 10A–10D, a total of ten head fastening screw holes 14 are formed.

Figure 5:
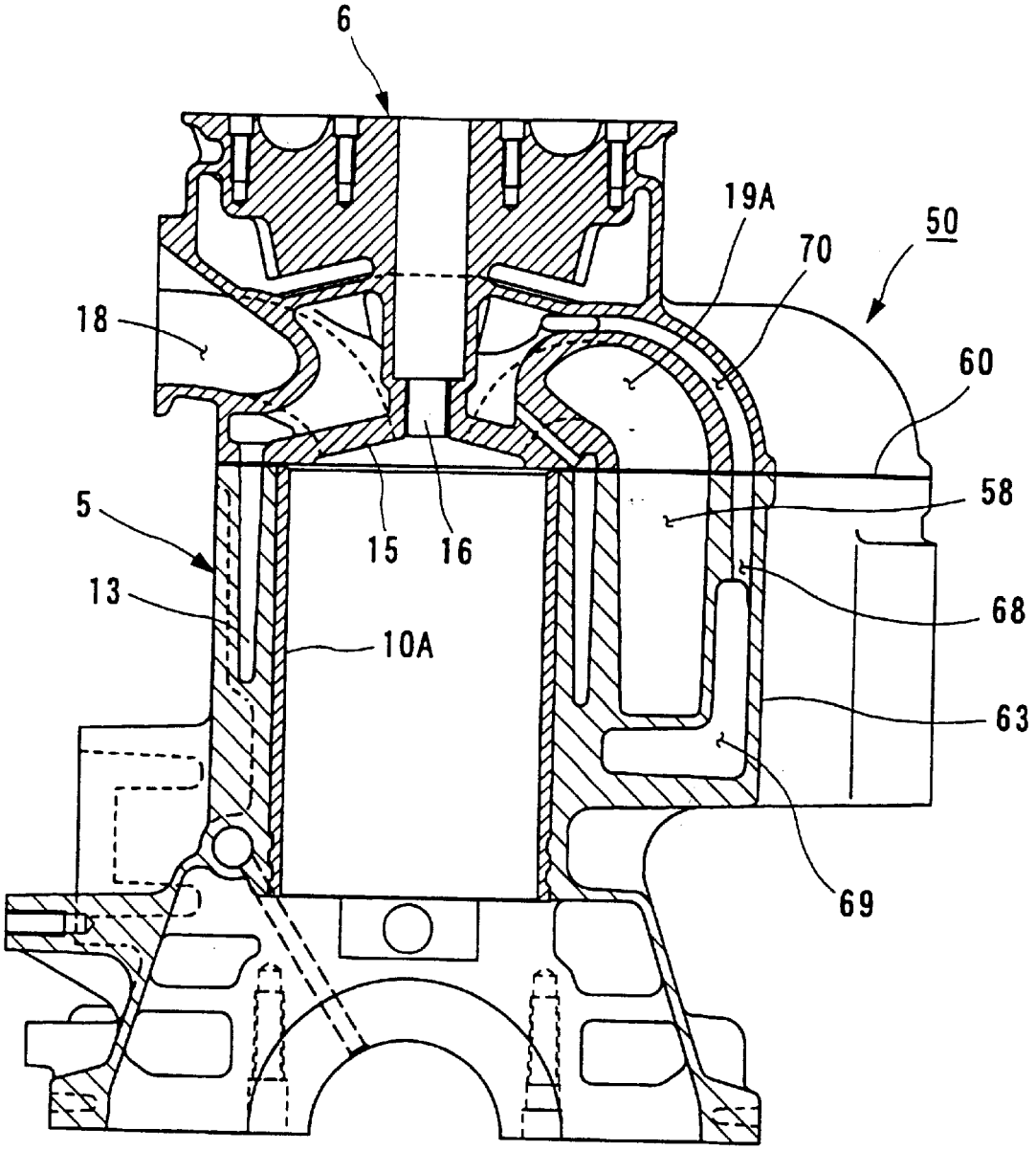
FIG. 5 is a horizontal sectional view of the cylinder block and the cylinder head along line V—V in FIG. 4.
Figure 6:
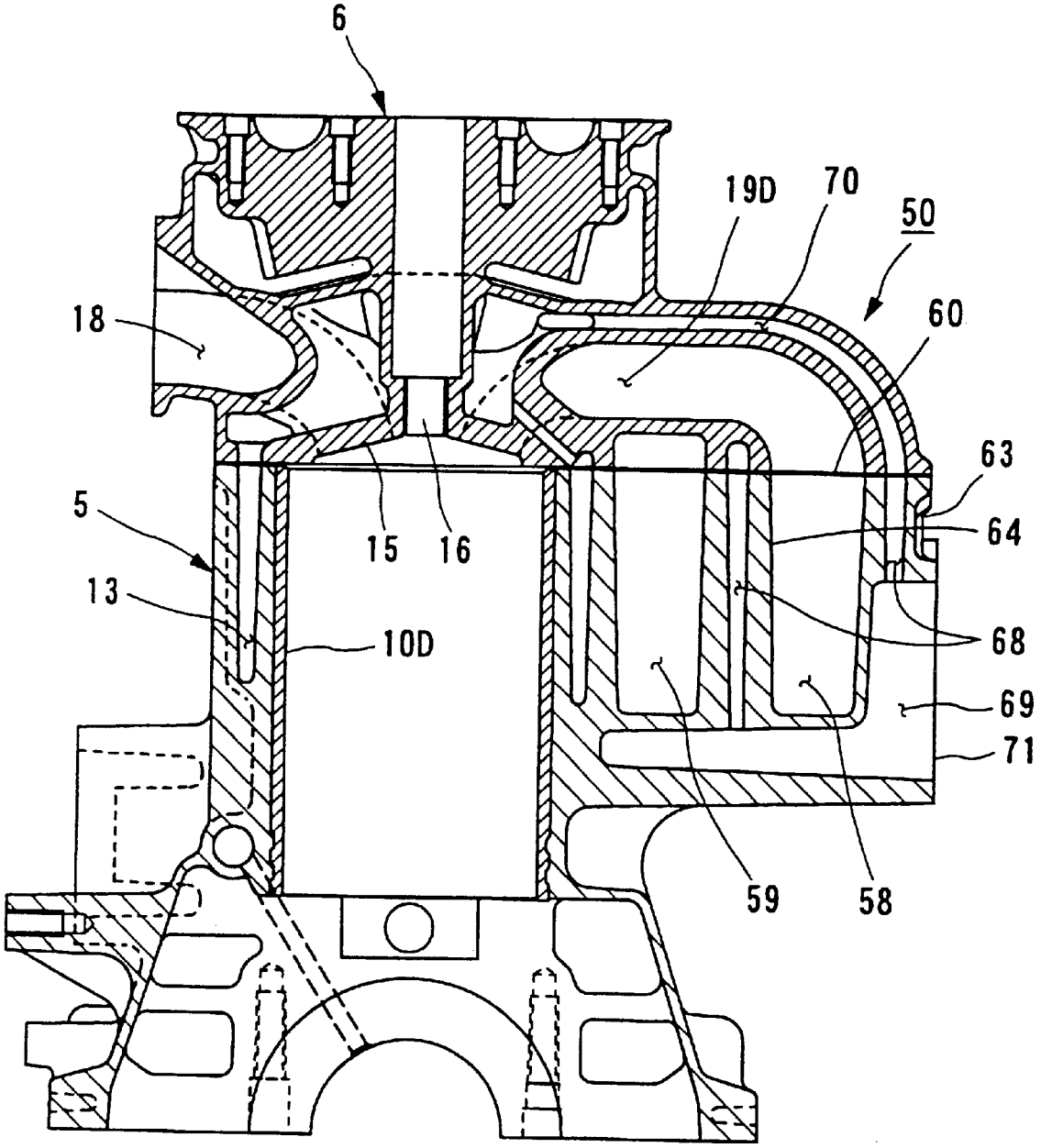
FIG. 6 is a horizontal sectional view of the cylinder block and the cylinder head along line VI—VI in FIG. 4.

As shown in FIGS. 5 and 6, four combustion chambers 15 are located in the cylinder head 6. The combustion chambers 15 are formed in concave and integrate with the cylinders 10A–10D of the cylinder block 5. A spark plug mounting hole 16 is formed at the center of each combustion chamber 15. Four intake ports 18 are formed at a side of each combustion chamber 15 (for example, at the right side, viewed from the front). Referring to FIGS. 4 through 6, four exhaust ports 19A–19D are formed at another side of the combustion chamber 15 (for example, at the left side, viewed from the front). Each intake port 18 opens at the right side of the cylinder head 6. Each exhaust port 19A–19D extends toward the left side of the cylinder head 6, curves toward the front side, and opens where the cylinder head 6 joins to the cylinder block 5.

As shown in FIG. 1, an engine holder 21, an oil pan 22, a drive housing 23 and a gear housing 24 are disposed and fixed on the bottom face of the engine 2, in downward order. A drive shaft 25 extends vertically through and is supported by these components, namely, engine holder 21, oil pan 22, drive housing 23 and gear housing 24. The drive shaft 25 is slightly offset toward the rear side away from the axis line of the crankshaft 3, and extends downward vertically. A driven gear 26 is located at the upper end of the drive shaft 25, and the drive shaft 25 and driven gear 26 turn together. A drive gear 27 is provided at the lower end of the crankshaft 3. The driven gear 26 engages with the drive gear 27 and turns together therewith. Thus, by the engagement between the drive gear 27 and the driven gear 26, rotation of the crankshaft 3 is transmitted to the drive shaft 25.

As shown in FIG. 1, a propeller shaft 29 is provided horizontally (in the front to rear direction) and is supported within the gear housing 24. A screw propeller 30 is disposed at the rear end of the propeller shaft 29 and turns together therewith. A bevel gear mechanism 31 and a clutch shifter 32 are disposed at a point where the propeller shaft 29 and the drive shaft 25 cross each other. Rotation of the drive shaft 25 is transmitted to the propeller shaft 29 via the bevel gear mechanism 31. The screw propeller 30 is thus driven to turn and generate propulsion. As the fixed rotation direction of the drive shaft 25 is switched between forward and reverse by the clutch shifter 32 and transmitted to the propeller shaft 29, the navigating direction of the outboard motor 1 (the hull of a boat) is selected between forward and reverse.

As shown in FIG. 1, a drive sprocket 33 is provided under the driven gear 26 to turn together therewith. A driven sprocket 34 is provided under the camshaft 8 so as to turn together therewith. A timing chain 35 is mounted around the driven sprocket 33 and the drive sprocket 34. Accordingly, the camshaft 8 turns with the drive shaft 25. When the camshaft 8 turns, a valve operating mechanism (not shown) provided within the cylinder head 6 is driven whereby intake valves and exhaust valves (not shown) open and close the intake ports 18 and exhaust ports 19A–19D at a prescribed timing.

As shown in FIG. 1, the engine 2, the engine holder 21 and the oil pan 22 are covered with an engine cover 36, which is made of a synthetic resin to protect these components from water. The engine cover 36 can be separated into upper and lower parts at the border of sealing material 37. Thus, the upper part of the engine cover 36 may be attached and removed to allow for inspections and maintenance services, on the engine 2.

As shown in FIG. 1, a clamp bracket 40 is provided on the front portion of the main body of the outboard motor 1 and is fixed to the transom of a boat (not shown). The clamp bracket 40 is provided with a swivel bracket 42 via a tilt shaft 41. A steering shaft 43 is supported vertically within the swivel bracket 42 so as to turn freely. At the upper end and the lower end of the steering shaft 43, an upper bracket 44 and a lower bracket 45 are provided, which turn together therewith.

As shown in FIG. 1, a pair of right and left upper mount units 46 are disposed in the vicinity of the front edge of the engine holder 21. The mount units 46 are coupled with the upper bracket 44. A pair of right and left lower mount units 47 are disposed at the right and left sides on the drive housing 23. The mount units 47 are coupled with the lower bracket 45. Accordingly, the main body of the outboard motor 1 can freely turn right and left (for steering) around the steering shaft 43 in relation to the clamp bracket 40, as well as be tilted upward around the tilt shaft 41.

Figure 3:
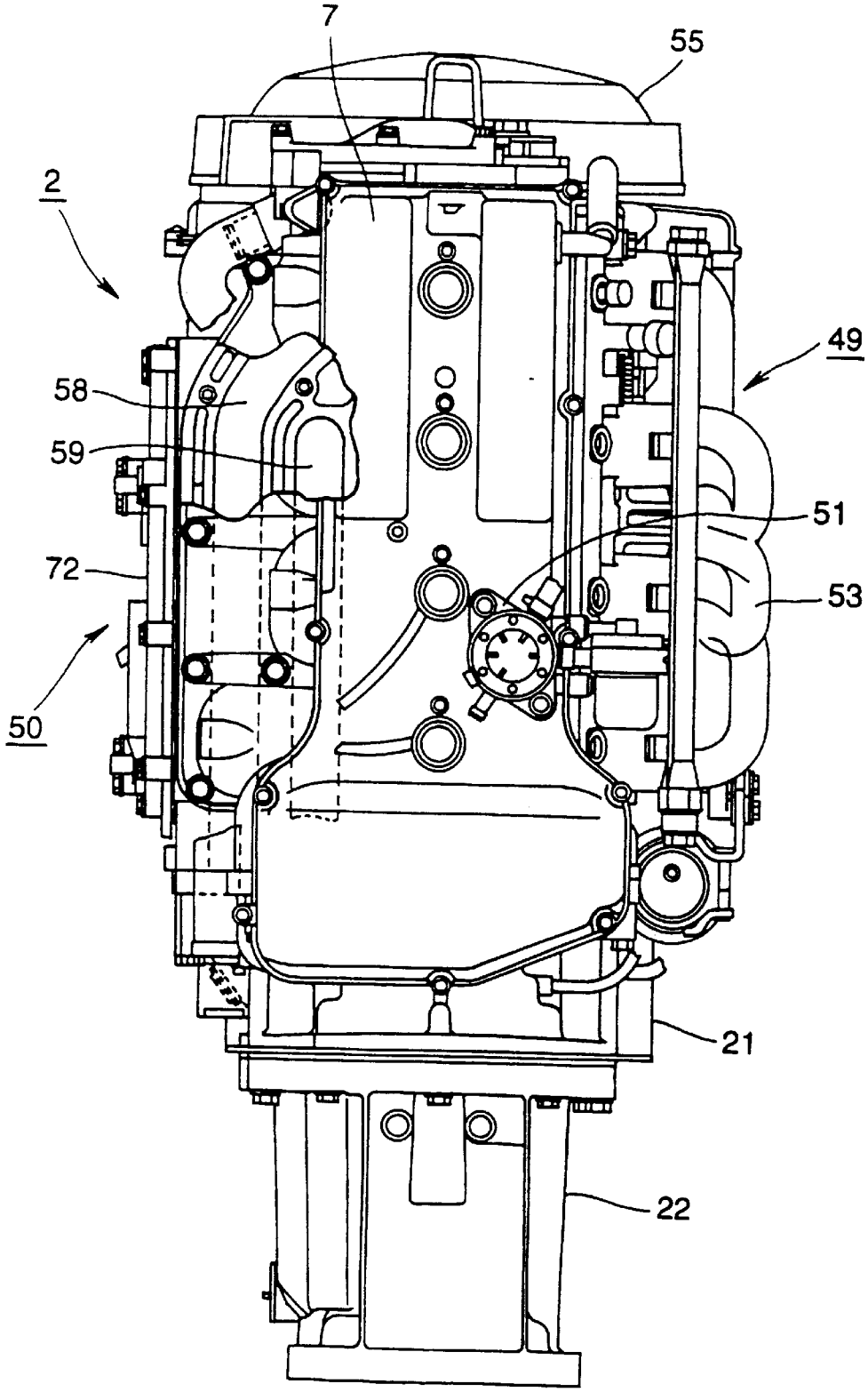
FIG. 3 is a rear view of the engine, the engine holder and the oil pan.

As shown in FIGS. 2 and 3, an intake system 49 is located at the right side of the engine 2, viewed from the rear. An exhaust system 50 is disposed at the left side of the engine 2, viewed from the rear. A fuel pump 51 is disposed on the back side of the engine 2. Also, as shown in FIG. 1, an oil pump 52 is disposed on the bottom surface of the cylinder head 6 and is driven by the camshaft 8.

An intake manifold 53 of the intake system 49 is divided into four branches that communicate with the four intake ports 18 of the cylinder head 6. As shown in FIG. 1, at the upper end of the crankshaft 3, a flywheel 54 projects over the upper surface of the engine 2 and is provided to turn integrally. The flywheel 54 is covered by a flywheel cover 55. A generator 56 is provided within the flywheel 54.

As shown in FIGS. 4 through 6, the exhaust system 50 generally comprises two independent exhaust passages 58, 59 that are integrally formed together with the cylinder block 5 at the left side thereof (viewed from the rear). The exhaust passages 58, 59 communicate with the exhaust ports 19A–19D that extend from each combustion chamber 15 on each cylinder 10A–10D in the cylinder head 6.

In one embodiment, as shown in FIGS. 4 through 6, the two exhaust passages 58, 59 are formed to extend in substantially vertical directions in a line in the width direction, i.e., from left to right in the outboard motor 1 (viewed from the rear). The exhaust passages 58, 59 are formed to be opened in a groove configuration on the side of the head connection face 60 (the joined surface of cylinder head 6) of the cylinder block 5. As shown in FIGS. 3 and 4, the inner exhaust,passage 59 is formed to extend downward directly outside (the left side, as viewed from the rear) of the cylinders 10B, 10C and 10D, while the outer exhaust passage 58 is formed so that it extends first diagonally left and downward, and then extends downward in the vertical direction along the outside of the inner exhaust passage 59.

As shown in FIG. 4, the lower portion of the inner exhaust passage 59 curves toward the outside and is joined with the outer exhaust passage 58 near the bottom end area to form an exhaust junction 61. Thus, the lowermost ends of both exhaust passages 58, 59 open at the bottom surface of the cylinder block 5 to form an exhaust port 62.

As shown in FIG. 4, on the outside external wall 63 of the exhaust passage 58 and on the bulkhead 64 that partitions the exhaust passages 58, 59, a total of eight head fastening screw holes 65 are formed. Using these head fastening screw holes 65, along with the ten head fastening screw holes 14 formed around the cylinders 10A–10D, as described above, the cylinder head 6 is fastened using two types (large and small) of fastening bolts. As a result, the openings of the exhaust passages 58, 59 are enclosed by the cylinder head 6 in an airtight manner.

As shown in FIGS. 4 through 6, a water jacket 68 is formed inside the external wall 63 and inside the bulkhead 64. In the rear view, in FIG. 4, this water jacket 68 looks as if it is intercepted by a plurality of the head fastening screw holes 65. However, as shown in FIGS. 5 and 6, the water jacket 68 communicates with a water jacket 69 provided around (for example, the front side and the left side) the exhaust passages 58, 59. Therefore, cooling water that flows inside the water jacket 69 also flows inside the water jacket 68. In addition, around the exhaust ports 19A–19D, a water jacket 70 is formed, which also connects to the water jacket 68.

Figure 7:
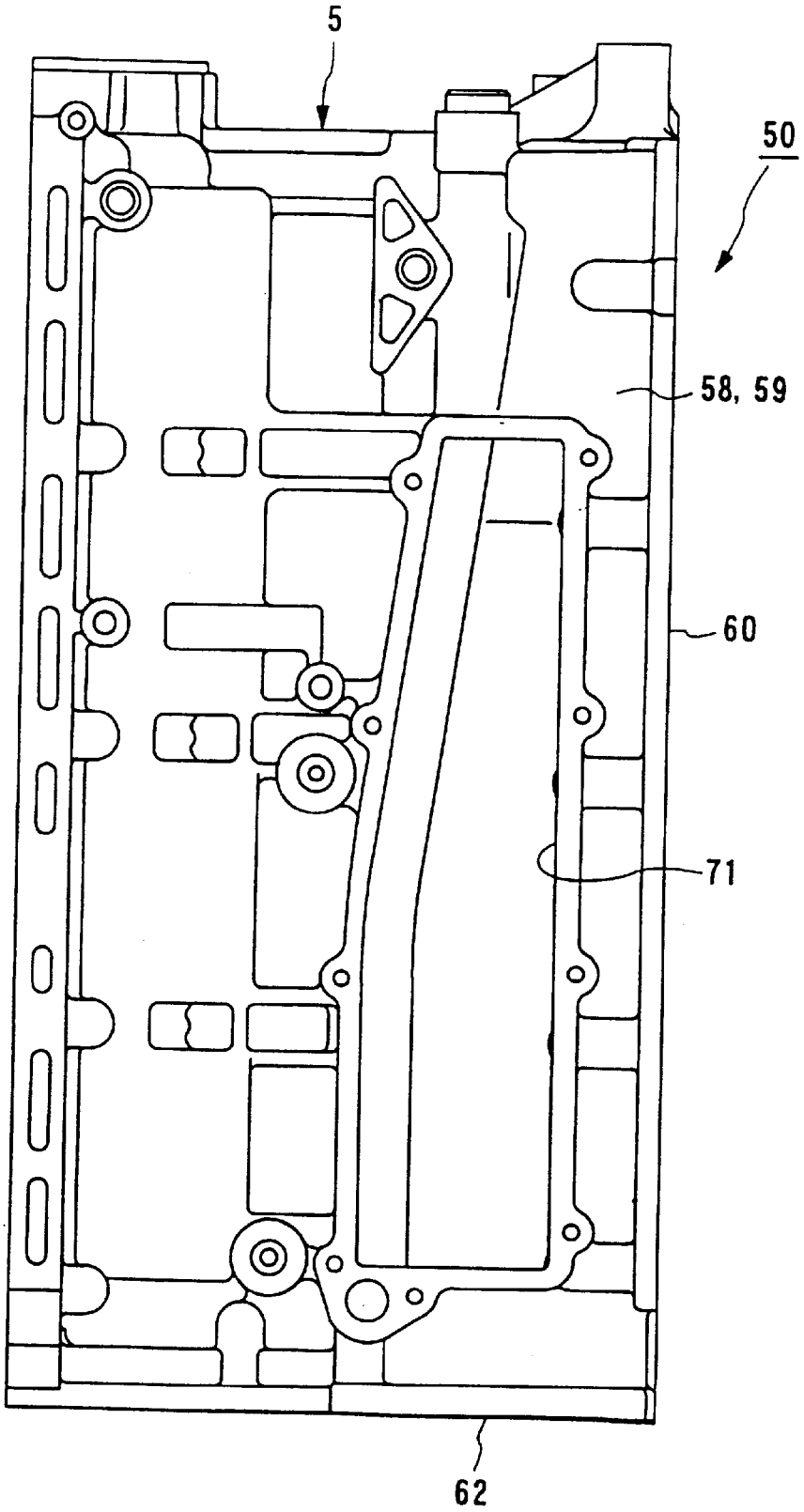
FIG. 7 is a left side view of the cylinder block, as viewed from the direction of arrow VII in FIG. 4.

As shown in FIGS. 6 and 7, in the bulkhead 63, an inspection hole 71, which communicates with the water jacket 69, is formed. As shown in FIGS. 2 and 3, this inspection hole 71 is enclosed by an exhaust cover 72 in an airtight manner.

As shown in FIGS. 4 through 6, each exhaust port 19A–19D that extends from each combustion chamber 15 of each cylinder 10A–10D communicates with one of the plurality of exhaust passages 58, 59. Thus, of the cylinders 10A–10D, the exhaust ports 19A–19D from the cylinders 10A–10D which have different exhaust timings are joined together into either the exhaust passage 58 or the exhaust passage 59. For example, the ignition sequence of this engine 2 is 10A→10C→10D→10B. As shown in FIG. 4, the exhaust port 19A and the exhaust port 19D from the cylinder 10A and the cylinder 10D, respectively, communicate with the outer exhaust passage 58, while the exhaust port 19B and the exhaust port 19C from the cylinder 10B and the cylinder 10C, respectively, communicate with the inner exhaust passage 59.

At the same time, the exhaust port of the cylinder in the lowest position among the cylinders 10A–10D communicates with the most distantly disposed exhaust passage of the plurality of exhaust passages 58, 59. In the present invention, as shown in FIGS. 4 and 6, the exhaust port 19D from the lowest positioned cylinder 10D communicates with the outer exhaust passage 58, crossing over the inner exhaust passage 59. Because the upper portion of the outer exhaust passage 58 is adjacent to the cylinder 10A, the exhaust port 19A from the cylinder 10A communicates with the exhaust passage 58 by a short distance, without crossing over the inner exhaust passage 59.

Further, the position where the exhaust port 19D from the lowest cylinder 10D communicates with the outer exhaust passage 58 is located further upstream, or higher, than the exhaust junction 61 where the inner exhaust passage 59 communicates with the outer exhaust passage 58. An exhaust passage (not shown) formed within the engine holder 21 is connected to the exhaust port 62. Furthermore, exhaust passages (not shown) formed inside the oil pan 22 and the drive housing 23 are connected sequentially.

As shown in FIG. 4, in the exhaust system 50 structure as described above, when the engine 2 starts, as indicated by arrows with broken lines, exhaust gases a, d are discharged from the cylinder 10A and the cylinder 10D, respectively, through the exhaust ports 19A and 19D, respectively, and are gathered in the outer exhaust passage 58. Similarly, exhaust gases b, c are discharged from the cylinder 10B and the cylinder 10C, respectively, through the exhaust ports 19B and 19C, respectively, and are gathered in the inner exhaust passage 59. Thus, the gases a, b, c, d are discharged in groups. The exhaust gases a, d that flow in the outer exhaust passage 58 and the exhaust gases b, c that flow in the inner exhaust passage 59 are joined at the exhaust junction 61, and are finally discharged outside (generally into water) through the exhaust passage (not shown) formed in the engine holder 21, the oil pan 22, and the drive housing 23.

In this manner, the exhaust gases a, d discharged from the cylinder 10A and the cylinder 10D, respectively, which have different exhaust timings, are collected in the outer exhaust passage 58, and the exhaust gases b, c discharged from the cylinder 10B and the cylinder 10C, respectively, are collected in the inner exhaust passage 59. Thus, the gases a, b, c, d are discharged in groups. This arrangement prevents exhaust interference from occurring between, for example, the exhaust gas from the cylinder 10A and the exhaust gas from the cylinder 10C, or between the exhaust gas from the cylinder 10B and the exhaust gas from the cylinder 10D. As a result, the charging efficiency of the intake fuel-air mixture is increased, which results in greatly increased output characteristics and torque characteristics.

In this exhaust system 50, because the two exhaust passages 58, 59 are integrally formed together with the cylinder block 5, it is not necessary to include separate components, such as an exhaust manifold, to construct the exhaust passages 58, 59. Therefore, it becomes possible to discharge exhaust gases in groups by providing exhaust passages 58, 59 that have simple structure, without increasing the number of components for the engine 2. This results in enhanced engine performance. Moreover, because the exhaust passages 58, 59 are formed easily together with the cylinder block 5 by die-casting, the manufacturing efficiencies of the engine 2 (cylinder block 5) and the exhaust system 50 are extremely good.

In addition, because the cylinder 10D is the lowest cylinder, the exhaust discharge distance from the cylinder 10D to the exhaust junction 61 (or the exhaust opening 62) is apt to be shorter than the exhaust discharge distance for the other cylinders 10A–10C. However, as the exhaust port 19D crosses over the inner exhaust passage 59 and communicates with the more distantly disposed outer exhaust passage 58, the exhaust port 19D may be made long enough to assure sufficient distance for the exhaust discharge distance from the cylinder 10D. Owing to this arrangement, the differences in the lengths of the exhaust discharge distances between the cylinders 10A–10D may be decreased, which results in a more effective prevention of exhaust interference.

Also, since the two exhaust passages 58, 59 are disposed in a line in the width direction of the outboard motor 1, it becomes possible to freely select the group exhaust combination by just changing the length of each exhaust port 19A–19D from each cylinder 10A–10D. Therefore, the designs of the exhaust system 50 and the engine 2 are extremely simple.

Still further, the exhaust junction 61 of the two exhaust passages 58, 59 is located further downstream than the joining point of the exhaust port 19D from the lowest cylinder 10D. Therefore, all of the exhaust ports 19A–19D communicate with either the exhaust passage 58 or the exhaust passage 59, and then the exhaust passage 58 and the exhaust passage 59 are joined together. With this arrangement, an effective 4-2-1 group exhaust format is provided, and any other exhaust passage connected downstream of the exhaust passages 58, 59 may be formed into one unit. Accordingly, the internal configuration of the engine holder 21 and the oil pan 22, etc., can be made relatively simple.

Furthermore, as shown in FIGS. 4 through 6, the water jacket 68, which is formed in the external wall 63 outside the exhaust passage 58 inside the bulkhead 64 and which partitions the exhaust passage 58 from the exhaust passage 59, communicates with the water jacket 69 that is provided around the exhaust passages 58, 59. Thus, the circulation of the cooling water inside the water jacket 68 is favorable, and, as a result, the exhaust passages 58, 59 are cooled effectively.

Figure 8:
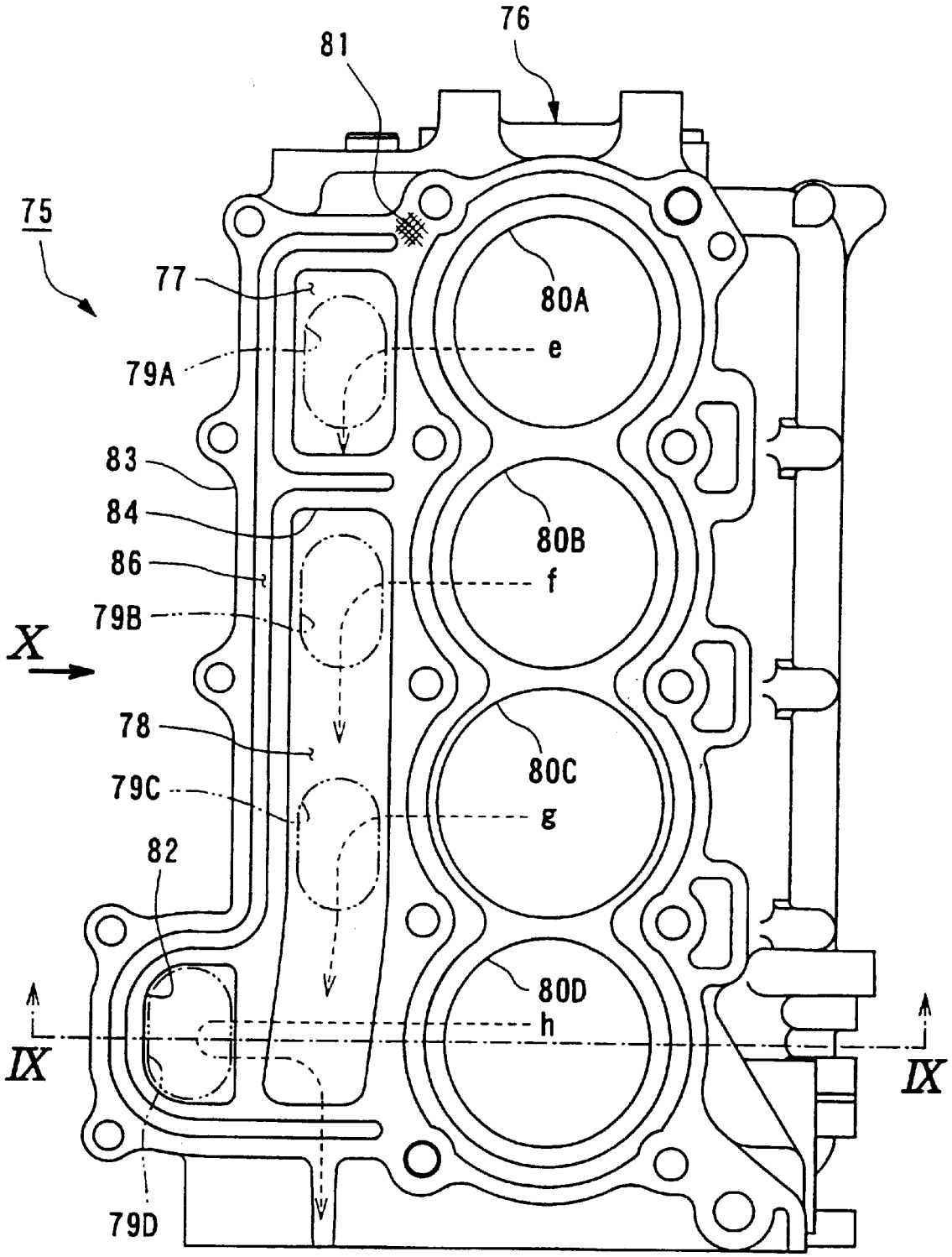
FIG. 8 is a rear view of a cylinder block showing another embodiment of the present invention.
Figure 9:
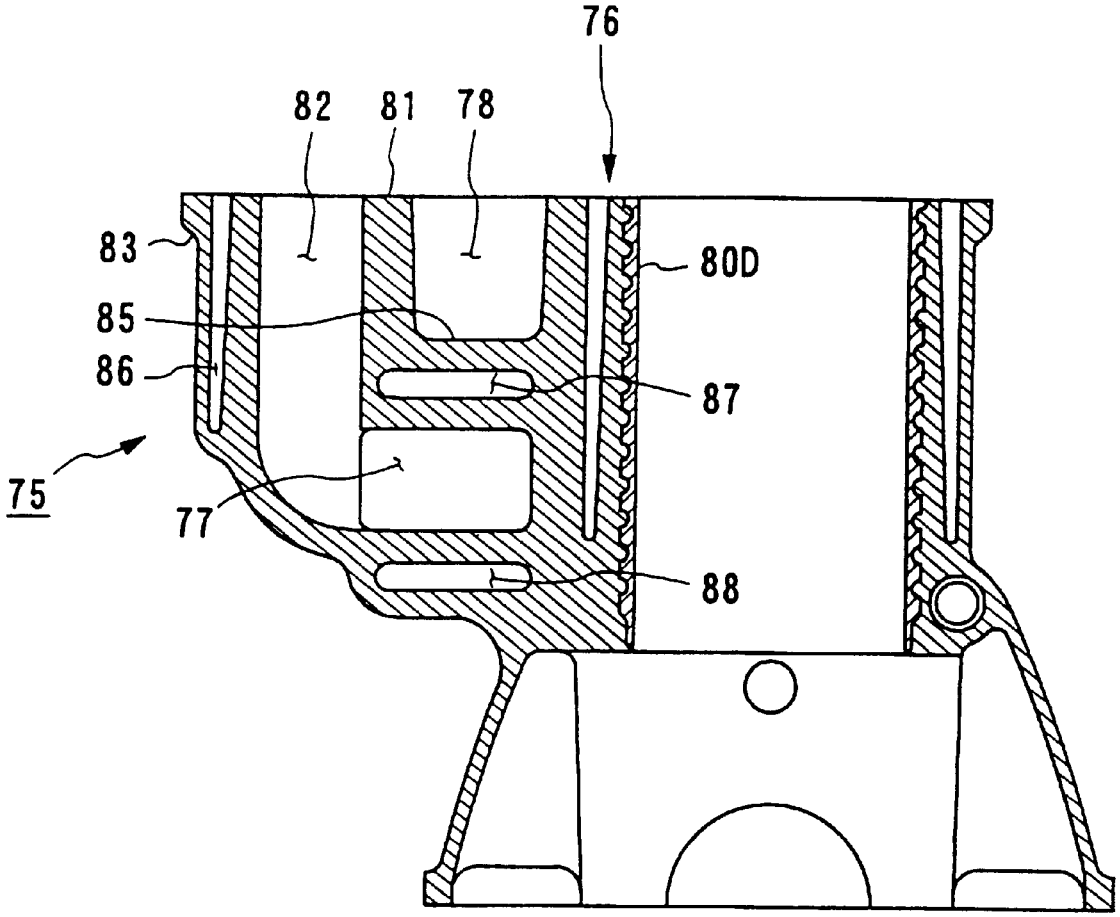
FIG. 9 is a horizontal sectional view of the cylinder block along line IX—IX in FIG. 8.
Figure 10:
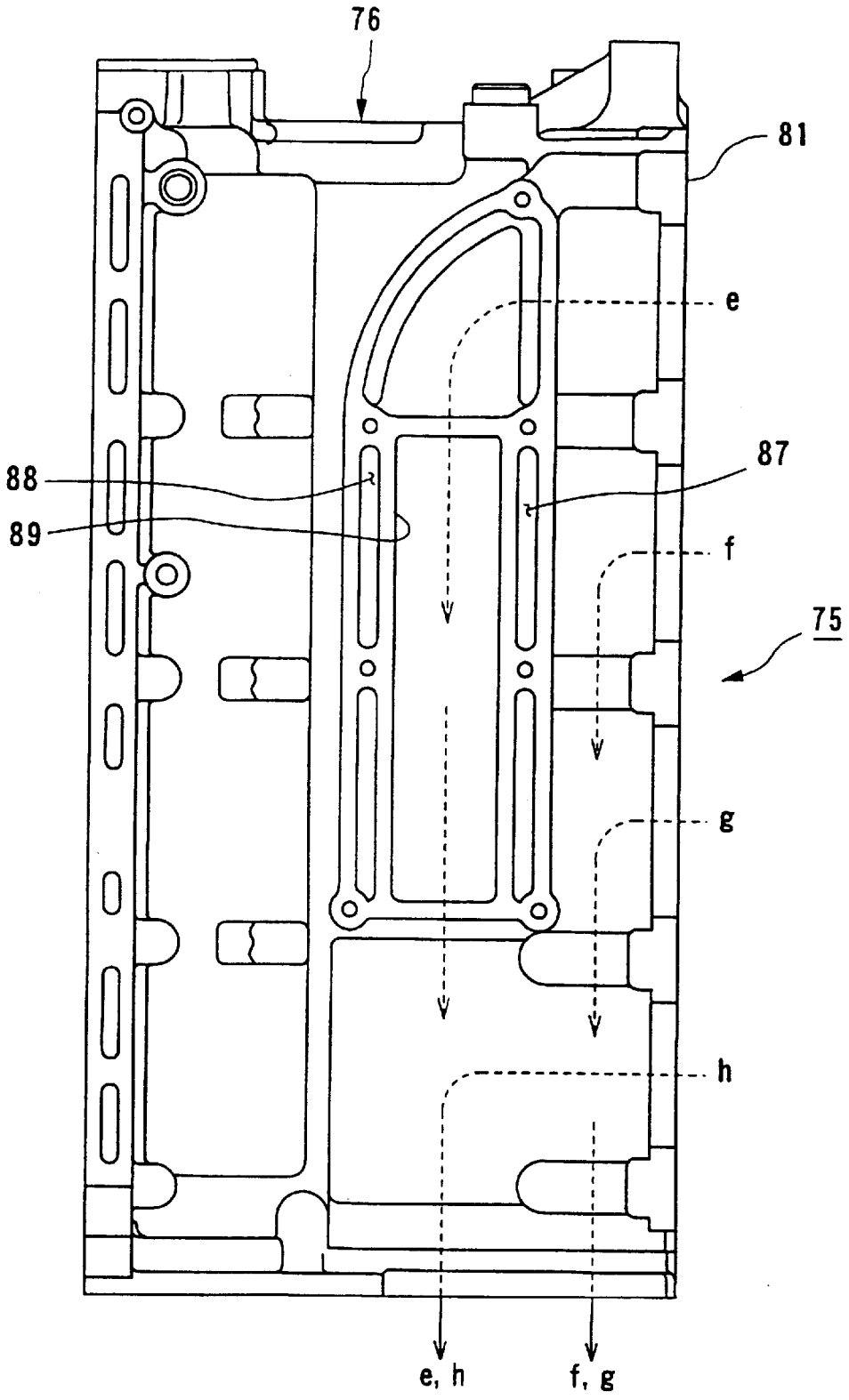
FIG. 10 is a left side view of the cylinder block, as viewed from the direction of arrow X in FIG. 8.
Figure 11:
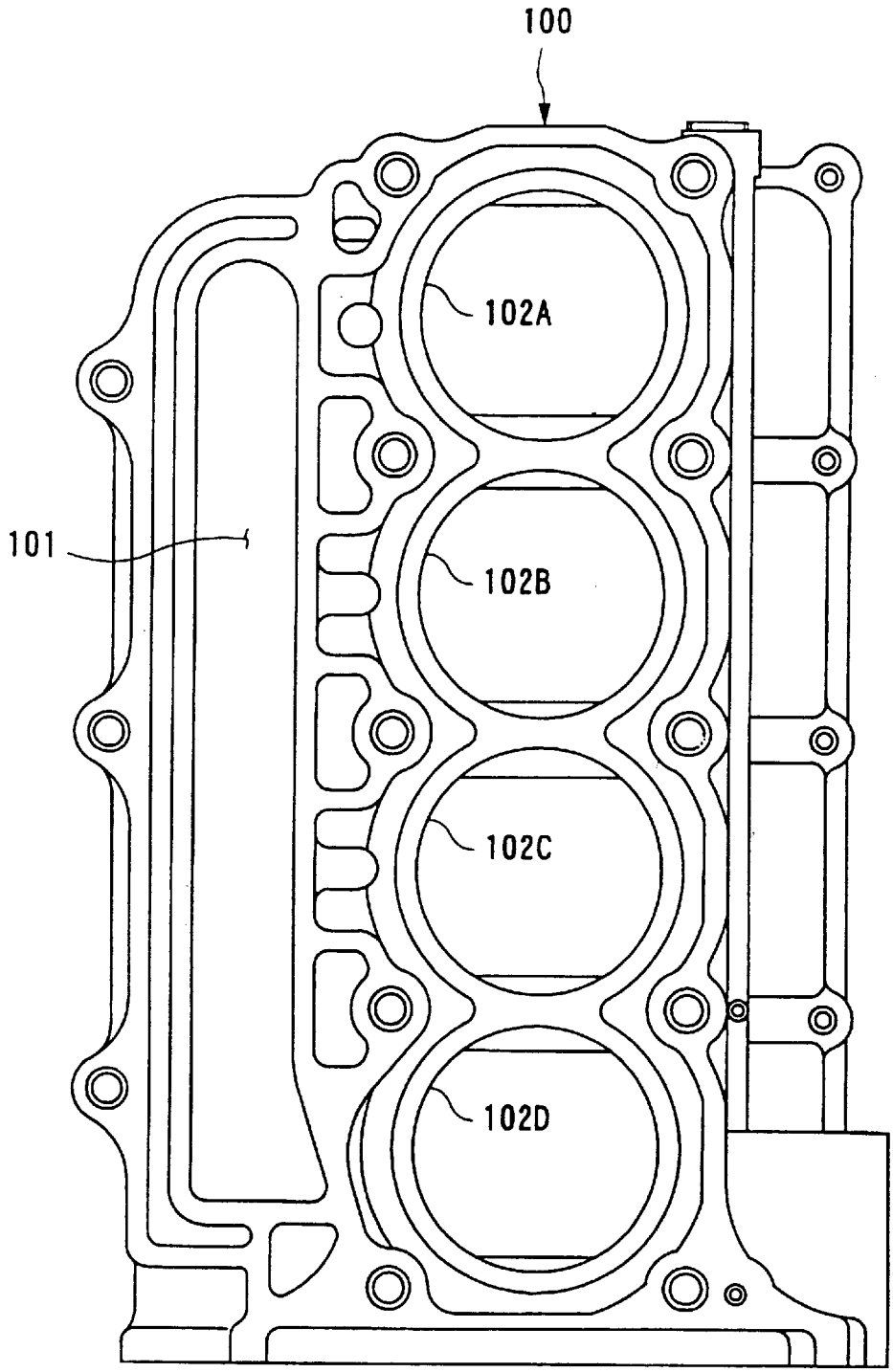
FIGURE 11 PRIOR ART
FIG. 11 is a rear view of a cylinder block depicting prior art.

FIGS. 8 through 10 illustrate another embodiment of the exhaust system of the present invention. The exhaust system 75 is comprised of, generally in the same manner as the exhaust system 50 of the first embodiment, two separate exhaust passages 77, 78 formed integrally on the left side of the cylinder block 76, four exhaust ports 79A–79D extending from combustion chambers (not shown), four cylinders 80A–80D, and a joint passage 82, which will be described later.

The two exhaust passages 77, 78, which extend in the vertical direction, are formed on the left side (viewed from the rear) of each cylinder 80A–80D in the cylinder block 76 in a front to rear direction in the outboard motor 1. The upper end of the exhaust passage 77 opens in a head connection face 81 of the cylinder block 76 at a place adjacent to the left side of the cylinder 80A. From there, the exhaust passage 77 extends a short distance toward the front and then turns at a 90° angle and extends downward. Thus, the exhaust passage 77 is formed generally in an upside down "L" shape. The lower end of the exhaust passage 77 opens at the bottom surface of the cylinder block 76.

The other exhaust passage 78 is formed in a groove configuration opened on the side of the head connection face 81 and extends downward along the outside (the left side, viewed from the rear) of the cylinders 80B, 80C and 80D. The lower end of the exhaust passage 78 opens in the bottom face of the cylinder block 76. The lower ends of the plurality of exhaust passages 77, 78 open in the bottom face of the cylinder block 76 separately or after being joined integrally into one. Generally, because the exhaust passage 77 is positioned in front of the other exhaust passage 78, the exhaust passages may be called the front exhaust passage 77 and the rear exhaust passage 78.

Preferably, the joint passage 82 is formed at the lowest, outside point of the exhaust passages 77, 78. The joint passage 82 extends in the front to rear direction (the axial direction of the cylinder 80D) along the outside of the exhaust passages 77, 78. One end of the joint passage 82 opens in the head connection face 81, and the other end communicates with the lower end of the exhaust passage 77.

As shown in FIGS. 8 and 9, within the external wall 83 forming the exhaust passages 77, 78 and the bulkheads 84, 85, water jackets 86, 87 and 88 are formed. In the external wall 83, as shown in FIG. 10, an inspection hole 89 is formed that communicates with the water jacket 86. The inspection hole 89 is enclosed by an exhaust cover (not shown).

Because the cylinder head is joined to the cylinder block 76 at the head connection face 81, the exhaust passages 77, 78 are closed by the cylinder head at the open side in an airtight manner. As shown in FIG. 8, the exhaust ports 79A and 79D from the cylinder 80A and the cylinder 80D, respectively, which have different exhaust timings, communicate with the exhaust passage 77, while the exhaust ports 79B and 79C from the cylinder 80B and the cylinder 80C, respectively, communicate with the exhaust passage 78. In particular, the exhaust port 79D from the cylinder 80D initially communicates with the joint passage 82 and then joins with the exhaust passage 77 through the joint passage 82.

When the engine starts, as shown with arrows with broken lines in FIGS. 8 and 10, exhaust gases e, h are discharged from the cylinder 80A and the cylinder 80D, respectively, through the exhaust ports 79A and 79D, respectively, and are gathered into the exhaust passage 77 and the joint passage 82. Similarly, exhaust gases f, g are discharged from the cylinder 80B and the cylinder 80C, respectively, through the exhaust ports 79B and 79C, respectively, and are gathered into the exhaust passage 78. The gases e, f, g, h are thus exhausted in respective groups.

In the exhaust system 75, by forming the exhaust passages 77, 78 integrally together with the cylinder block 76, it becomes possible to discharge exhaust gases in groups using a simple structure, without increasing the number of components for the engine 2. This results in improved performance by preventing exhaust interference from occurring. Further, as the exhaust port 79D from the lowest cylinder 80D communicates with the exhaust passage 77, which is located further away than the exhaust passage 78, through the joint passage 82, the differences in lengths between the exhaust distance from the cylinder 80D and the exhaust distance from the cylinders 80A–80C are decreased. This results in more effective prevention of exhaust interference.

Furthermore, as the exhaust passages 77, 78 are formed in a double layer in the front to rear direction in the outboard motor 1 (at the left side of the cylinder block 76), the exhaust passages 77, 78 do not greatly project out from the left side surface (viewed from the rear) of the cylinder block 76. Therefore, compared to the exhaust system 50 of the first embodiment, the exhaust passages 77, 78 may be arranged effectively in terms of space, and the designs of the exhaust system 75 and its surroundings may be easily designed.

In the first embodiment and the second embodiment described above, it is assumed that the engine 2 is an in-line four-cylinder engine. However, it is possible to apply the exhaust system of the present invention to, for example, V-type engines or horizontal opposed-cylinder-type, etc., or any multi-cylinder engine having other arrangements of cylinders. Therefore, a wide range of variations may exist in terms of the configuration and the number of exhaust passages provided in the cylinder block, or in the configuration of communicating the exhaust ports with the exhaust passages or grouping thereof.

According to the exhaust system for an outboard motor of the present invention, as described above, in the outboard motor equipped with a four-stroke engine having a cylinder block comprising a plurality of cylinders arranged vertically so that a crankshaft is vertically oriented, because a plurality of separate exhaust passages that extend vertically are formed integrally and each of the exhaust passages communicates with at least one of the exhaust ports from a plurality of cylinders having different respective exhaust timings, it becomes possible to provide an exhaust system with simple structure and with enhanced engine performance that provides group exhaust from a plurality of cylinders and prevents exhaust interference from occurring, while featuring a simple design and good manufacturing characteristics for the engine and the exhaust system.

Also, in the exhaust system for an outboard motor relating to the present invention, because the exhaust port from the cylinder located in the lowest position communicates with the most distantly disposed exhaust passage out of the plurality of exhaust passages, it becomes possible to decrease the differences in the lengths of the exhaust discharge distances between the cylinders, including the lengths of the exhaust ports, which results in more effective prevention of exhaust interference from occurring.

Further, in the exhaust system for an outboard motor relating to the present invention, because the plurality of exhaust passages are joined together at a point further downstream from a point where the exhaust port from the lowest cylinder is joined, it becomes possible to carry out effective group exhaust, as well as to simplify the structure of the exhaust system.

Moreover, in the exhaust system for an outboard motor relating to the present invention, because, in one embodiment, the plurality of exhaust passages are arranged in a line in the width direction of the outboard motor, it becomes possible to freely select the combination of group exhaust, as well as to simplify the design of the exhaust structure and engine.

Furthermore, in the exhaust system for an outboard motor relating to the present invention, because, in a second embodiment, the plurality of exhaust passages are arranged in a line in the longitudinal (front to rear) direction of the outboard motor, it becomes possible to provide a plurality of exhaust passages in a spatially beneficial manner and to make the design of the exhaust system easy.

Still further, in the exhaust system for an outboard motor relating to the present invention, because a water jacket is formed inside the bulkhead that partitions the plurality of exhaust passages, the cooling efficiency of the exhaust passages is enhanced.

Still further, in the exhaust system for an outboard motor relating to the present invention, because the water jacket formed inside the bulkhead communicates with a water jacket that is provided around the exhaust passages, the circulation of the cooling water within the water jackets may be enhanced to effectively cool the exhaust passages.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

| Description of Reference Numerals | |
|---|---|
| 1 | Outboard motor |
| 2 | Engine |
| 3 | Crankshaft |
| 5, 76 | Cylinder block |
| 50, 75 | Exhaust system |
| 58, 59, 77, 78 | Exhaust passages |
| 10A–10D, 80A–80D | Cylinders |
| 19A–19D, 79A–79D | Exhaust ports |
| 64, 84, 85 | Bulkhead |
| 68, 69, 86, 87, 88 | Water jackets |

What is claimed is:

1. An exhaust system for an outboard motor equipped with a four-stroke in-line engine having a cylinder block comprising a plurality of cylinders arranged vertically so that a crankshaft is vertically oriented, and a plurality of separate exhaust passages that extend vertically and are formed integrally with the cylinder block, wherein each of the exhaust ports from the plurality of cylinders which have different respective exhaust timings communicates with at least one of the plurality of exhaust passages.

2. An exhaust system for an outboard motor according to claim 1, wherein the plurality of exhaust passages are arranged to be disposed in a line in the width direction of the outboard motor.

3. An exhaust system for an outboard motor equipped with a four-stroke engine having a cylinder block comprising a plurality of cylinders arranged vertically so that a crankshaft is vertically oriented, and a plurality of separate exhaust passages that extend vertically and are formed integrally with the cylinder block, wherein each of the exhaust ports from the plurality of cylinders which have different respective exhaust timings communicates with at least one of the plurality of exhaust passages, and wherein the exhaust port from the cylinder disposed in the lowest position out of the plurality of cylinders communicates with the exhaust passage disposed at a more distant position out of the plurality of separate exhaust passages.

4. An exhaust system for an outboard motor equipped with a four-stroke engine having a cylinder block comprising a plurality of cylinders arranged vertically so that a crankshaft is vertically oriented, and a plurality of separate exhaust passages that extend vertically and are formed integrally with the cylinder block, wherein each of the exhaust ports from the plurality of cylinders which have different respective exhaust timings communicates with at least one of the plurality of exhaust passages, and wherein the plurality of exhaust passages are arranged to be disposed in a line in the front to rear direction of the outboard motor.

5. An exhaust system for an outboard motor equipped with a four-stroke engine having a cylinder block comprising a plurality of cylinders arranged vertically so that a crankshaft is vertically oriented, and a plurality of separate exhaust passages that extend vertically and are formed integrally with the cylinder block, wherein each of the exhaust ports from the plurality of cylinders which have different respective exhaust timings communicates with at least one of the plurality of exhaust passages, and wherein a water jacket is formed within a bulkhead that partitions the plurality of exhaust passages.

6. An exhaust system for an outboard motor according to claim 5, wherein the water jacket formed within the bulkhead communicates with a water jacket that is provided around the plurality of exhaust passages.

7. An exhaust system for an outboard motor equipped with a four-stroke in-line engine having a cylinder block comprising:

a plurality of cylinders, the cylinders arranged vertically so that a crankshaft is vertically oriented, the cylinders having different respective exhaust timings, and each cylinder having an exhaust port, and a plurality of separate exhaust passages, each exhaust passage extending in the vertical direction and being formed integrally with the cylinder block, wherein each exhaust port from each cylinder communicates with at least one of the plurality of exhaust passages.

8. An exhaust system for an outboard motor equipped with a four-stroke engine having a cylinder block comprising:

a plurality of cylinders, the cylinders arranged vertically so that a crankshaft is vertically oriented, the cylinders having different respective exhaust timings, and each cylinder having an exhaust port, and a plurality of separate exhaust passages, each exhaust passage extending in the vertical direction and being formed integrally with the cylinder block, wherein each exhaust port from each cylinder communicates with at least one of the plurality of exhaust passages, and wherein the plurality of exhaust passages are comprised of an inner exhaust passage and an outer exhaust passage which are arranged in a line in the width direction of the outboard motor.

9. An exhaust system for an outboard motor according to claim 8, wherein the exhaust port from the cylinder disposed in the lowest position out of the plurality of cylinders communicates with the outer exhaust passage.

10. An exhaust system for an outboard motor equipped with a four-stroke engine having a cylinder block comprising:

a plurality of cylinders, the cylinders arranged vertically so that a crankshaft is vertically oriented, the cylinders having different respective exhaust timings, and each cylinder having an exhaust port, and a plurality of separate exhaust passages, each exhaust passage extending in the vertical direction and being formed integrally with the cylinder block, wherein each exhaust port from each cylinder communicates with at least one of the plurality of exhaust passages, and wherein the plurality of exhaust passages are comprised of a front exhaust passage and a rear exhaust passage which are arranged in a line in the front to rear direction of the outboard motor.

11. An exhaust system for an outboard motor according to claim 10, further comprising a joint passage, wherein the exhaust port from the cylinder disposed in the lowest position out of the plurality of cylinders communicates with the front exhaust passage through the joint passage.

12. An exhaust system for an outboard motor equipped with a four-stroke engine having a cylinder block comprising:

a plurality of cylinders, the cylinders arranged vertically so that a crankshaft is vertically oriented, the cylinders having different respective exhaust timings, and each cylinder having an exhaust port, and a plurality of separate exhaust passages, each exhaust passage extending in the vertical direction and being formed integrally with the cylinder block, wherein each exhaust port from each cylinder communicates with at least one of the plurality of exhaust passages, and wherein a water jacket is formed within a bulkhead that partitions the plurality of exhaust passages.

13. An exhaust system for an outboard motor according to claim 12, wherein the water jacket formed within the bulkhead communicates with a water jacket that is provided around the plurality of exhaust passages.

* * * * *